United States Patent [19]

Wilkinson

[11] Patent Number: 4,539,795

[45] Date of Patent: Sep. 10, 1985

[54] ORIENTATION, ACCUMULATION AND POSITIONING MACHINE

[75] Inventor: Donald R. Wilkinson, Clemmons, N.C.

[73] Assignee: R. J. Reynolds Tobacco Company, Winston-Salem, N.C.

[21] Appl. No.: 517,199

[22] Filed: Jul. 26, 1983

[51] Int. Cl.[3] ..... B65B 35/40; B65B 35/54

[52] U.S. Cl. ..... 53/542; 53/544; 53/168; 53/202; 53/252; 198/448; 414/46

[58] Field of Search ..... 53/168, 202, 237, 244, 53/252, 531, 537, 542, 544; 198/431, 448; 414/38, 46

[56] References Cited

U.S. PATENT DOCUMENTS

| | | | |
|---|---|---|---|
| 3,046,712 | 7/1962 | Carter | 53/537 |
| 3,513,623 | 5/1970 | Pearson | 53/543 |
| 4,056,200 | 11/1977 | Provost | 198/431 |
| 4,176,993 | 12/1979 | Luginbühl | 414/46 |

*Primary Examiner*—Robert L. Spruill
*Assistant Examiner*—Richard M. Mudd
*Attorney, Agent, or Firm*—Manford R. Haxton

[57] ABSTRACT

A machine for orienting, accumulating and positioning packages received from two sources for loading into containers has an oscillating member which oscillates between the two sources during which time it both receives packages from one source while participating in loading packages into a container from the other source. Associated with the oscillating member and with each source is an orienting mechanism which rotates packages received from its associated source so that they rest on a common one of their sides, an accumulating mechanism which collects the packages rotated by the orienting mechanism into a group of a predetermined number, a positioning mechanism which positions the grouped packages onto the oscillating member, and a loading mechanism which advances the positioned and grouped packages from the oscillating member into the container.

15 Claims, 9 Drawing Figures

FIG.1
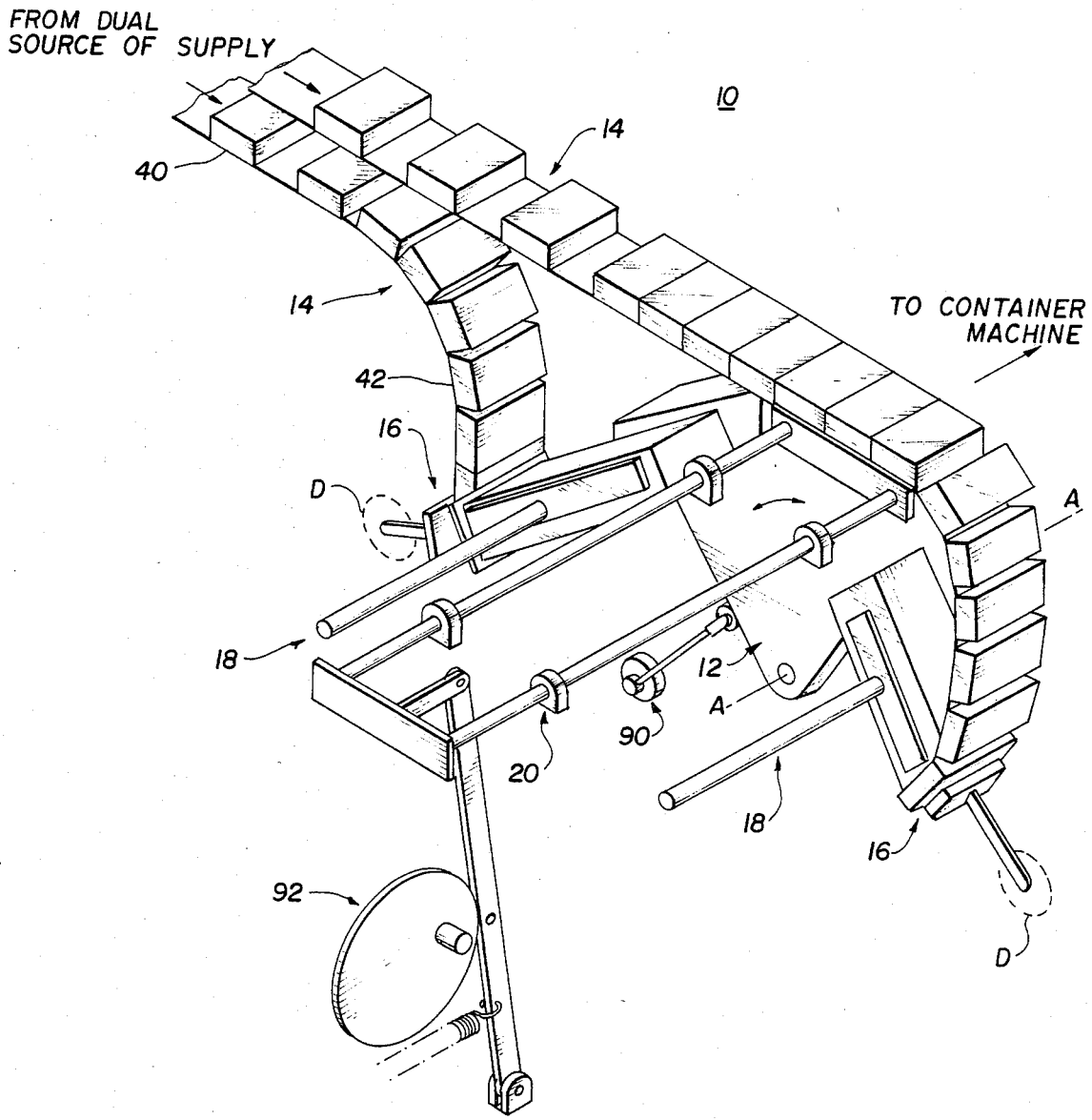
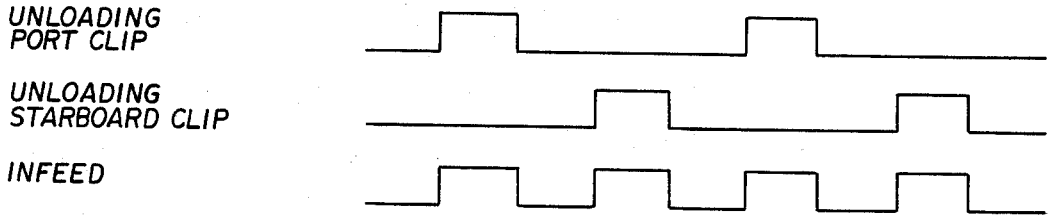
FIG.8

FIG. 2
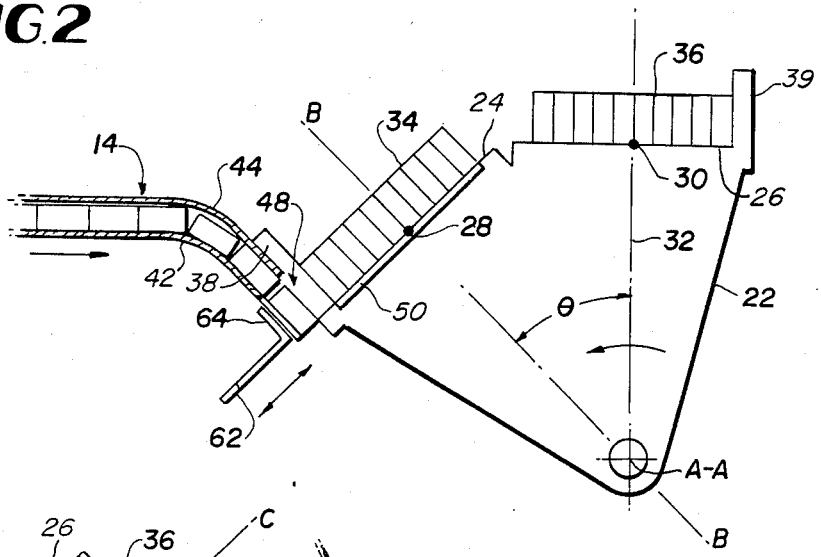
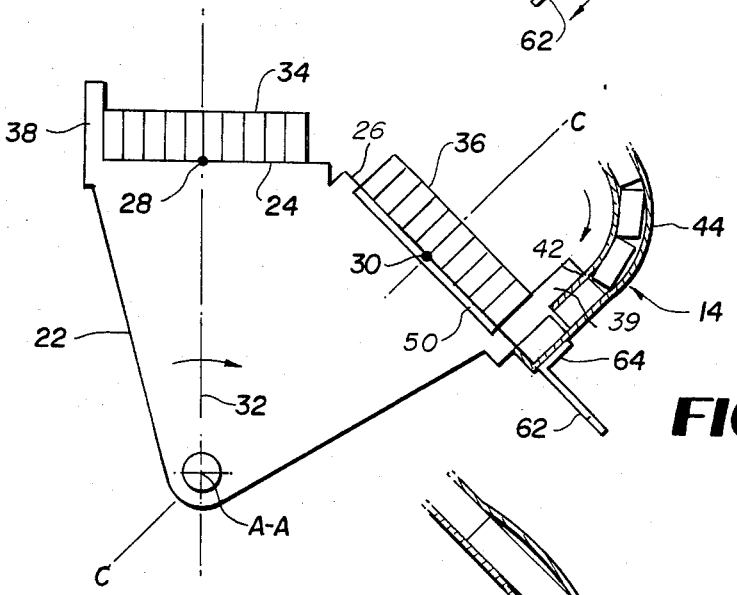
FIG. 3
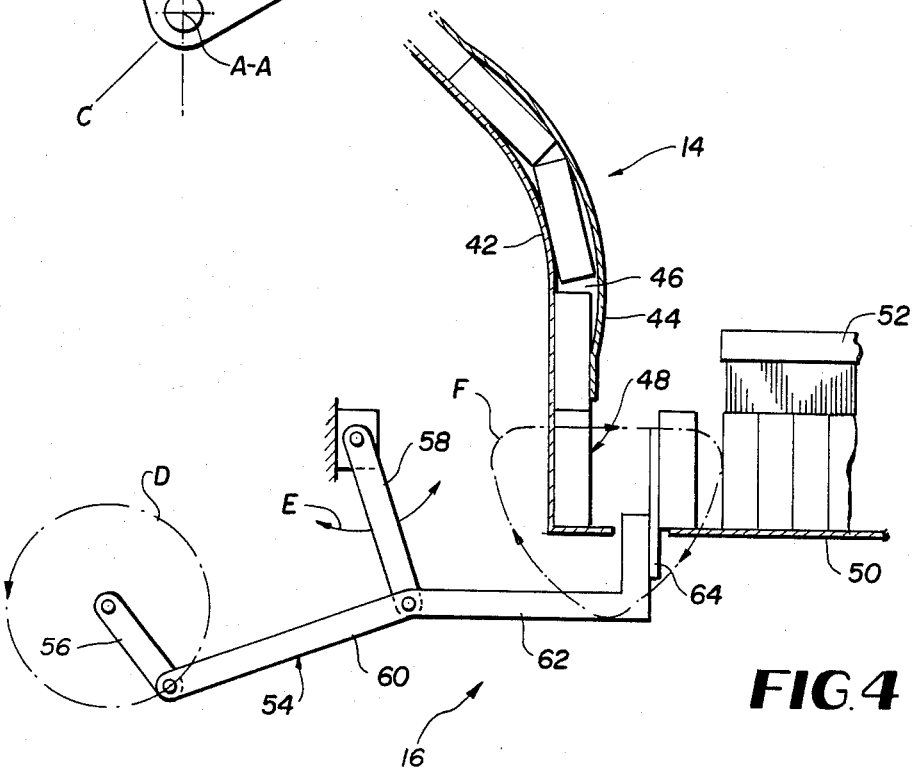
FIG. 4

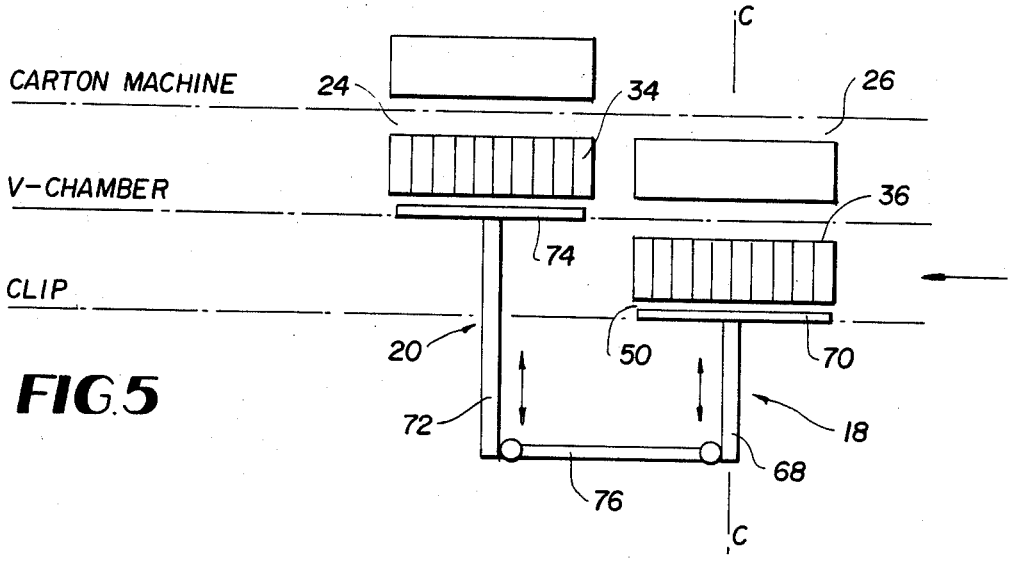
FIG.5
FIG.6
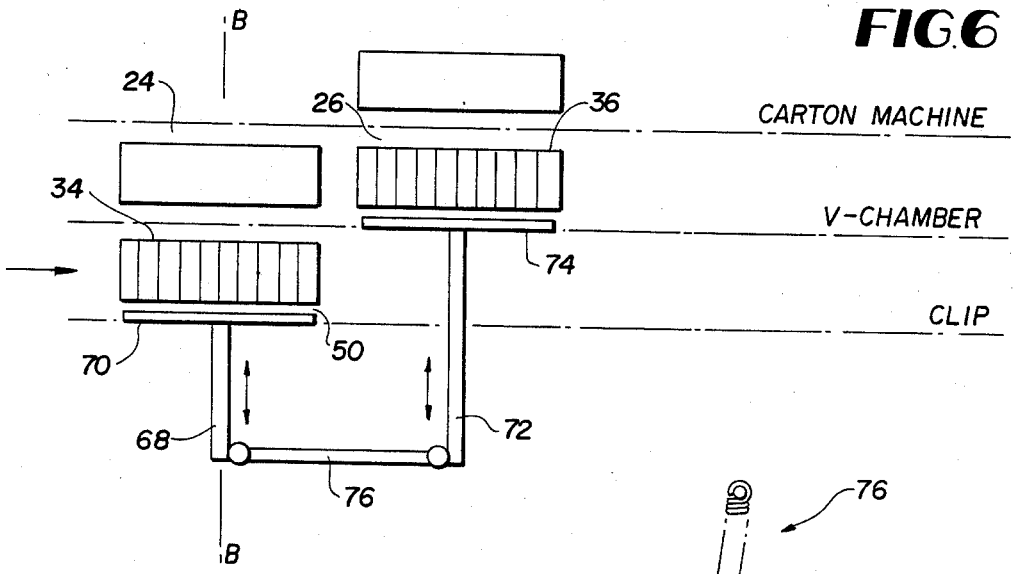
FIG.7
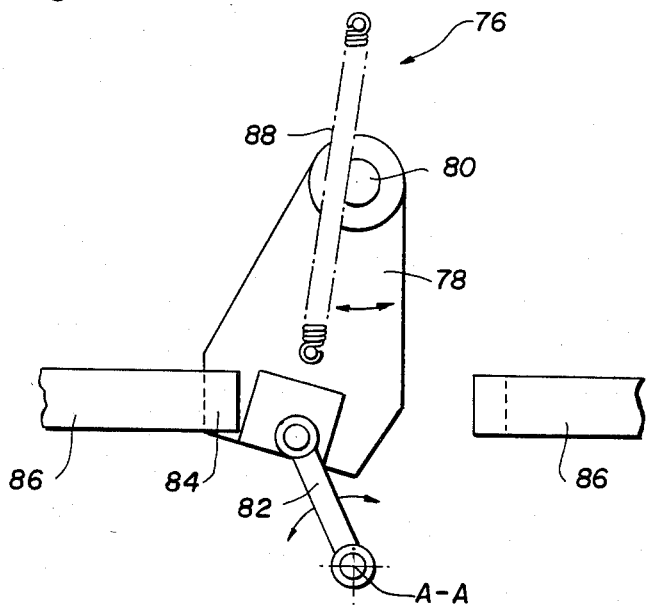

FIG. 9

| MECHANISM | SENSORS | | | | | | | | | | | | | | | | | | | | | | | | | | | | | | | | ACTION TAKEN |
|---|---|---|---|---|---|---|---|---|---|---|---|---|---|---|---|---|---|---|---|---|---|---|---|---|---|---|---|---|---|---|---|---|---|
| | PORT SUPPLY 1st | | PORT SUPPLY 2nd | | PORT PACKAGE | | CLIP FULL (PORT) | | V-CHAMBER (PORT) | | PLUNGER OUT (PORT) | | STARBOARD SUPPLY 1st | | STARBOARD SUPPLY 2nd | | STARBOARD PACKAGE | | CLIP FULL (STARBOARD) | | V-CHAMBER (STARBOARD) | | PLUNGER OUT (STARBOARD) | | CARTON OR CASE MACHINE | | | | | | | |
| STATE | ON | OF | ON | OF | ON | OF | ON | OF | ON | OF | ON | OF | ON | OF | ON | OF | ON | OF | ON | OF | ON | OF | ON | OF | ON | OF | ON | OF | ON | OF | ON | OF | |
| PORT CLIP FEED CLUTCH | X | | X | | X | | | X | | | X | | | | | | | | | | | | | | | | X | | | | | | ENERGIZE SOLENOID |
| STARBOARD CLIP FEED CLUTCH | | | | | | | | | | | | | X | | X | | X | | | X | | | X | | X | | | | | | | | ENERGIZE SOLENOID |
| V-CHAMBER ROCKER CLUTCH | OR | | | | | | X | | | | X | | | | | | | | | | | | X | | X | | | | | | | | ENERGIZE SOLENOID |
| MAIN PLUNGER CAM CLUTCH | OR | | | | | | X | | X | | X | | | | | | | | X | | X | | X | | X | | | | | | | | ENERGIZE SOLENOID |

ORIENTATION, ACCUMULATION AND POSITIONING MACHINE

BACKGROUND OF THE INVENTION

1. Field of the Invention

The present invention relates to a machine for orienting, accumulating and positioning packages for loading into containers.

According to one application of the present invention, the machine orients, accumulates and positions cigarette packages for loading into cartons for shipment.

2. Prior Art

In general, in the high volume handling of packaged items, manufacturers have frequently relied on at least partially automated systems to at least accumulate the packages for loading into the containers for shipment. Refer, for example, to U.S. Pat. Nos. 2,884,114; 3,815,321 and 3,924,758. In particular, in the field of cigarette manufacturing, machines for handling cigarette packages received from cigarette making machines and interfacing with revenue stamping machines or carton loading machines are known. See U.S. Pat. No. 1,402,223 for an example of the former. In the case of the latter, the machines, known as up-ender machines, typically include a continuous chain containing package receiving pockets. Ten pockets are provided for handling ten packages of cigarettes. The packages are accumulated at a station adjacent to the cigarette making machinery, and are pushed into the pockets in the chain as it is brought into registry with the packages at the accumulation station. From the accumulation station the chain transports the packages in the pockets to a carton receiving station where the packages are removed from the pockets and loaded into cartons. At at least the carton loading station the chain is controlled by an indexing mechanism to insure that the pockets are properly aligned for delivery to the cartons. The indexing mechanism is a source of problems for the cigarette manufacturer primarily because the clutches which form a major part of the indexing mechanism are not sufficiently reliable to provide the positive indexing necessary, i.e., proper alignment, to insure relatively continuous operation.

Also included in the known up-ender machines is an accumulating apparatus which receives the cigarettes from two simultaneously operating cigarette package wrapping machines, brings them together, rotates them onto a narrow edge of the package (up-ending) and accumulates them at the accumulating station. The accumulating apparatus is also a source of problems for the cigarette manufacturer because of the damage caused to the packages and the failure to properly accumulate packages (often less than the desired number of packages are accumulated for transfer to the chain). In addition, both the indexing mechanism and the accumulating apparatus are not as efficient as the manufacturer would like, i.e., they are relatively slow operating devices which are subject to high maintenance costs. The chain in particular is less than desirable because the pockets are not adaptable to different size packages. To handle a different size package would require an entirely separate installation, which is costly.

It would therefore be desirable to have a machine as part of a package loading installation which is more efficient, less apt to cause package damage, and more adaptable to handling different size packages.

OBJECTS AND SUMMARY OF THE INVENTION

One object of the present invention, therefore, is to have a machine as part of a package loading installation which is more efficient from the speed and maintenance point of view.

It is another object of the present invention to have a machine like that defined in the previously stated object which is adaptable to handle different size packages.

Another object of the present invention is to provide a machine like that defined in the previously stated objects which operates automatically subsequent to filling of the packages for loading of the packages into containers.

Another object of the present invention is to provide a machine like that referred to in the previously stated objects which re-orients, accumulates and positions the packages for loading into containers and to do so continuously.

A related object of the present invention is to provide a machine like that referred to in the previously stated objects which is safe for the packages, is easily maintainable and synchronized for rapid operation in conjunction with the operation of the package source apparatus and the container apparatus which receive the packages.

A specific object of the present invention is to provide a machine for handling cigarette packages subsequent to being filled with cigarettes and for the purpose of loading the packages into cartons in a particular orientation and grouping.

A related specific object of the present invention is to provide a machine similar to that referred to in the previously stated object which replaces the existing pocket containing chain type apparatus now widely in use in the cigarette manufacturing industry for handling cigarette packages for loading.

With the present invention, each of the stated objects is achieved. In summary: the present invention is adapted to continuously receive packages from two sources alternatively, and to orient the packages from each source into a common mode, accumulate them into a predetermined grouping, position them for loading into containers and finally loading them into containers.

In more specific structural terms the machine embodying the invention features an oscillating member which moves between the two sources. The packages are received from each source and first re-oriented by a re-orienting mechanism into the noted common mode, i.e., they are rotated to rest on a common one of their sides. The packages thus oriented are accumulated by an accumulating mechanism into a predetermined grouping, i.e., they are collected into a group of a predetermined number and assembled onto the oscillating member by a positioning mechanism. From their position on the oscillating member, the grouped packages are then advanced by a loading mechanism into the containers.

The operation of the various mechanisms are synchronized with the oscillation of the oscillating member so that the desired continuous operation is maintained. In this way, the operation of the sources and the container handling apparatus is likewise maintained continuous resulting in an efficient overall operation.

BRIEF DESCRIPTION OF THE DRAWINGS

Nine figures have been selected to illustrate the preferred embodiment and best mode of the present invention. The illustrations of structure are schematic in their presentation. They are nevertheless, sufficiently detailed to inform those skilled in the art. Included are:

FIG. 1, which is a schematic perspective view of the assembled machine located relative to the supply conveyor belts and the carton loading machine;

FIG. 2, which is an elevational view of the V-chamber in position for port loading;

FIG. 3, which is an elevational view of the V-chamber in position for starboard loading;

FIG. 4 which is a schematic view of a clip loading plunger; and

FIG. 5, which is a schematic top view illustrating the relationship between the main plunger and the starboard plunger, as well as the relative location of each and the oscillating V-chamber, the carton machine and the starboard clip;

FIG. 6, which is a schematic top view illustrating the relationship between the main plunger and the port plunger, as well as the relative location of each and the oscillating V-chamber, the carton machine and the port clip;

FIG. 7, which is a schematic view illustrating the mechanical latching mechanism for connecting either the port or starboard plunger to the main plunger;

FIG. 8 which is a timing diagram of package movements from the port and starboard clips to the V-chamber; and FIG. 9 which is a truth chart for overall control.

DETAILED DESCRIPTION OF A PREFERRED EMBODIMENT

The machine according to the present invention is situated in an overall system for handling packages between a dual source of supply of packages and a container machine for receiving a preselected number of packages (FIG. 1). A dual source of supply is referenced because it is traditional in the manufacture of cigarettes, which is the preferred, although not exclusive, field of application for the invention. Many more sources of supply could be handled by the machine by simply controlling the flow into the orienting mechanism of the machine.

The machine 10 includes eight subassemblies: an oscillating subassembly 12; two orienting subassemblies 14; two accumulating subassemblies 16; two positioning subassemblies 18; and a loading subassembly 20. The subassemblies are shown in assembly in FIG. 1.

The oscillating subassembly 12 oscillates between the two sources of supply, i.e., between each of the other pairs of subassemblies, and in the process receives packages originating from each source, while participating with the loading subassembly in loading the packages received into containers at the container machine. The two orienting subassemblies 14 are identical as are the two accumulating subassemblies 16 and the two positioning subassemblies 18. For reference purposes they will be designated as starboard and port subassemblies. The orienting subassemblies 14 interface with the conveyor system (not shown) from a respective source of supply. They receive the packages from an associated source of supply and re-orient, or rotate, the packages so that they eventually will rest in an associated accumulating subassembly on a common side. In the case of cigarettes, on one of the narrow edges. The accumulating subassemblies 16 are associated with the respective orienting subassembly and collect the packages rotated by the orienting subassembly into a group of predetermined number. The positioning subassemblies 18 associated with each orienting subassembly and accumulating subassembly causes the grouped packages to be transferred to the oscillating subassembly 12. The loading subassembly 20 advances the positioned group of packages transferred to the oscillating subassembly to containers at the container machine.

The essence of the oscillating subassembly 12 is an oscillating member 22, referred hereinafter as the V-chamber 22 (FIGS. 2 and 3). The V-chamber 22 comprises a plate mounted to pivot about axis A—A between two extreme positions defined by planes B—B (FIG. 2) and C—C (FIG. 3). The V-chamber 22 therefore oscillates between planes B—B, C—C. The angle of oscillation $\theta$ is arbitrary, and for the typical cigarette manufacturing system is approximately 45°. The V-chamber 22 defines two surfaces 24 and 26 each including a midpoint 28 and 30, respectively, which lie on a common radius 32 from the oscillating axis A—A. The surfaces 24 and 26 extend, therefore, tangentially to the radius 32 and serve to receive the group of packages 34, from the port positioning subassembly and the group of packages 36 from the starboard positioning subassembly. At the outer extremity of each surface 24 and 26, there is located a limiting flange 38 and 39, respectively, which serve to support the grouped packages when they are received from a respective positioning subassembly. With the limiting flanges 38 and 39, the surfaces 24 and 26 define a positioned group of packages, i.e., the group of packages 34 and 36 are each a positioned group of packages. What this means is that the group of packages are aligned with the opening in the container at the container machine so that they can be moved into the container by the loading subassembly without interference.

Each orienting subassembly 14 includes a conveyor having a straight segment 40 (FIG. 1) and a curved segment 42 (FIGS. 1 and 4). Typically, the conveyor can be a series of rollers. The straight segment 40 interfaces directly with the conveyor from an associate source of supply and receives the packages in seriatim originating from that source. The packages received are carried by the straight segment 40 to the curved segment 42 which reorients or rotates each package so that they are supported on a different surface from that on which they are supported on the straight segment. In the case of cigarette packages, the packages are rotated to rest on one of their narrow surfaces (FIG. 4). To better control the rotation of the packages, the orienting subassemblies include a guide plate 44 which extends substantially parallel to at least the curved segment 40. The guide plate and curved segment thus define a passage 46 through which the packages pass in the process of rotation. The passage 46 terminates in a staging region 48 of the associated accumulating subassembly 16.

The staging region 48 is defined as one end segment of a package receiving surface 50 of the accumulating subassembly. The package receiving surface 50 is referred to as a clip in which the packages rotated by the associated orienting subassembly are collected into a group of predetermined number. Typically the clip 50 is situated substantially perpendicular to the curved segment 42 at the staging region 48, but at an angle to the true horizontal (FIG. 1). In this posture an arresting mechanism is necessary to prevent movement of the packages back toward the associated orienting subassembly. The arresting mechanism comprises one or more brushes 52 situated above and parallel to surface 50.

An actuating mechanism in the form of a crank and rocker linkage 54 is provided as part of each accumulating subassembly. The crank and rocker linkage 54 serves to transfer packages from the curved segment 42, and in particular from the staging region 48, further into the clip 50, where the previously noted collection occurs. The crank and rocker linkage 54 includes a crank 56, a rocker link 58, a connecting link 60 and an extension link 62 which includes a package engaging flange 64. The various movement paths traced by the crank 56, the rocker link 58 and the package engaging flange 64 are shown in dashed lines in FIG. 4 and are identified as paths D, E and F, respectively. To achieve the path F, the package receiving surface 50 is provided with a slot 66 at the staging region 48. The slot 66 exposes only a limited portion of the package at the staging region 48, and is sufficiently wide to accomodate the flange 64.

From the package receiving surface of the clip 50, the group packages 34 and 36 of predetermined number are transferred to an associated surface of the V-chamber 22 by an associated positioning subassembly 18. For this purpose, the package receiving surface is further situated to be substantially parallel to and transversely displaced from an associated surface of the V-chamber 22, when the V-chamber 22 is at either extreme position B—B or C—C. This relationship is shown in FIGS. 5 and 6.

Each positioning subassembly 18 includes a plunger 68 having a package engaging front plate 70. The plate 70 is preferably co-extensive with the grouped packages 34, 36. The plunger 68 and plate 70 serve to effect the transfer noted above according to which the grouped packages 34, 36 are transferred to surfaces 24 and 26, respectively, when the V-chamber 22 is in extreme position B—B and C—C, respectively.

When the V-chamber 22 is in each extreme position, one of its surfaces 24, 26 is in position for transferring the positioned grouped packages to a container. For this purpose the loading subassembly 20 is employed. The loading subassembly 20 includes a plunger 74 having a package engaging front plate 72. The plate 72, like the plates 70 is preferably co-extensive with the positioned grouped packages 34, 36. The movement of the plungers 68 and 70 and their associated front plates 70 and 74 is coordinated by a latching mechanism 76. With the latching mechanism 76 it is possible to position grouped packages 34 from the port clip onto surface 24 at extreme position B—B of V-chamber 22 employing the port plunger 68 and its front plate 70 while the loading plunger 72 and its front plate 74 is transferring previously grouped packages 36 from surface 26 into a container (FIG. 6). Likewise, with the latching mechanism 76 it is possible to position grouped packages 36 from the starboard clip onto surface 26 at extreme position C—C of V-chamber 22 employing the starboard plunger 68 and its front plate 70 while the loading plunger 72 and its front plate 74 is transferring previously grouped packages 34 from surface 24 into a container (FIG. 5).

The latch mechanism 76 which is shown in FIG. 7, includes a latching cam 78 pivotably mounted at 80 to pivot with the V-chamber 22 between the two extreme positions noted. This is achieved by a position actuator 82 driven from the V-chamber pivot shaft. At each extreme position, the latching cam 78 engages a groove 84 in an extension arm or follower 86 of each plunger 68. In this way, the movement of the loading plunger 70 and the port and starboard plungers 68 can be alternately united to effect the result noted above. An overcenter spring 88 is provided to urge the latching cam 78 to an extreme position subsequent to a loading stroke of the loading plunger 70.

With the machine described it is possible to achieve an alternating unloading of the port and starboard clips of grouped packages for loading into a container while maintaining a steady infeed from two sources of supply. The relationship is shown in the timing diagram of FIG. 8.

The displacements of the V-chamber 22 and plungers 72 can be effected by cam drives 90 and 92, respectively (FIG. 1). The actuation of these cam drives as well as the actuation of the cranks 56 are preferably effected by solenoid controlled clutches. For example, each clutch has two positive stops, and each 180° rotation of the clutch of crank 56 equals one package pushed by the flange 64, and each 180° rotation of the V-chamber clutch equals a 45° rotation of the V-chamber. The energization schedule of the various solenoids is shown in the table illustrated in FIG. 9. This schedule is believed to be self explanatory and need not be discussed in detail.

As previously noted, the present invention was developed for use in the manufacture of cigarettes. It can be applied, however, whereever a series of packages are to be gathered for loading into shipping containers, where the packages originate from at least two sources of supply.

What is claimed is:

1. A machine for orienting, accumulating and positioning packages received from two sources for loading into containers, comprising:

oscillating means including an oscillating member which oscillates between the two sources, and in the process both receives packages from one source while participating in loading packages into a container from the other source;

orienting means associated with each source which receive packages from its associated source and rotates each package to rest on a common one of its sides;

accumulating means associated with each orienting means for collecting the packages rotated by the orienting means into a group of a predetermined number;

positioning means associated with each orienting means and accumulating means for positioning the grouped packages onto the oscillating member; and loading means for advancing the positioned group of packages from the oscillating member into a container.

2. The machine as defined in claim 1, wherein the oscillating member:

(i) defines two extreme positions during its oscillation between two sources; and (ii) includes a surface for receiving each group of packages from the positioning means thereby defining a positioned group of packages, the surfaces being relatively located such that;

(iii) at each extreme position of the oscillating member packages are grouped onto one surface from one source while the other surface is located to advance a previously positioned group of packages from the other source into a container.

3. The machine as defined in claim 2, further wherein the oscillating member:

(iv) defines an oscillating axis; and (v) the surfaces of the oscillating member have their midpoints located at a common radius from the oscillating axis.

4. The machine as defined in claim 3, further wherein the surfaces of the oscillating member:

(vi) extend tangentially to the radius from the oscillating axis which intersects its midpoint.

5. The machine as defined in claim 4, further wherein the surfaces of the oscillating member:

(vii) each includes a limiting flange at its external edge for supporting the positioned group of packages when received from the positioning means.

6. The machine as defined in claim 2, further wherein:

(iv) the orienting means associated with each source includes a conveyor having a straight segment at one end for receiving packages, in seriatim, from the associated source and a curved segment at the other end associated with an accumulating means; and (v) the two segments serve to transfer the packages received from the associated source to the associated accumulating means such that the side of each package in engagement with the conveyor is oriented substantially perpendicularly to the surface of the oscillating member associated with the orienting means and accumulating means.

7. The machine as defined in claim 6, further wherein:

(vi) the orienting means also includes a guide plate spaced from and parallel to at least the curved segment of the conveyor.

8. The machine as defined in claim 6, wherein the accumulating means associated with each orienting means includes:

(vi) a package receiving surface extending substantially perpendicular to the curved segment of the conveyor and substantially parallel to and transversely displaced from a surface of the oscillating member when the oscillating member is in one of its extreme positions; and (vii) actuating means adapted to transfer packages from the curved segment of the conveyor to the package receiving surface where the packages are collected into a group of predetermined number.

9. The machine as defined in claim 8, wherein:

(viii) the actuating means comprises a crank and rocker linkage having a package engaging extension.

10. The machine as defined in claim 8, further wherein the accumulating means includes:

(viii) arresting means associated with the package receiving surface for preventing movement of the packages back to the orienting means.

11. The machine as defined in claim 10, wherein:

(ix) the arresting means comprise one or more brushes mounted above and parallel to the package receiving surface.

12. The machine as defined in claim 8, further wherein:

(viii) the positioning means associated with each orienting means and accumulating means comprises a plunger for transferring the grouped packages on the package receiving surface of the associated accumulating means to an associated surface of the oscillating member where the grouped packages are positioned for transfer to a container.

13. The machine as defined in claim 12, further wherein:

(ix) the loading means comprises a plunger for transferring the positioned grouped packages alternatively from each surface of the oscillating member to containers.

14. The machine as defined in claim 13, further comprising:

a latching mechanism for alternately connecting the plunger comprising the loading means with the plungers comprising each positioning means, such that positioned group packages are transferred to containers from one surface of the oscillating member while grouped packages are being positioned on the other surface of the oscillating member.

15. The machine as defined in claim 1, wherein:

(i) the packages are cigarette packages;

(ii) the two sources are cigarette filling or wrapping machines, each including a conveyor system; and (iii) each orienting means is operatively associated with a respective conveyor system.

* * * * *